US005307526A

United States Patent [19]

Appleby

[11] Patent Number: 5,307,526

[45] Date of Patent: May 3, 1994

[54] HAMMOCK STYLE CAMPERS' TOILET SEAT

[76] Inventor: James B. Appleby, 2080 127th Ave. NW., Coon Rapids, Minn. 55448

[21] Appl. No.: 928,518

[22] Filed: Aug. 11, 1992

[51] Int. Cl.[5] ..... A47K 11/00

[52] U.S. Cl. ..... 4/460; 4/483; 5/122

[58] Field of Search ..... 4/449, 460, 483, 484, 4/478, 479; 5/120, 122, 604

[56] References Cited

U.S. PATENT DOCUMENTS

| | | | |
|---|---|---|---|
| 362,969 | 5/1887 | Jacobus | 4/579 |
| 633,111 | 9/1899 | Bartlett | 5/122 X |
| 635,261 | 10/1899 | Lassiter | 5/604 X |
| 1,425,391 | 8/1922 | Munyon | 4/460 |
| 1,577,595 | 3/1926 | Smith | 4/460 |
| 1,695,374 | 12/1928 | Harrison | 4/237 |
| 2,694,208 | 11/1954 | Christensen | 5/122 |
| 2,722,968 | 11/1955 | Smith | 5/122 X |
| 3,122,397 | 2/1964 | Mintz | 4/484 X |
| 3,562,824 | 2/1971 | White | 5/604 X |
| 3,719,962 | 3/1973 | Burkley | 5/604 |
| 4,222,133 | 9/1980 | Csatary | 5/122 X |
| 5,170,521 | 12/1992 | Light | 5/122 X |

*Primary Examiner*—Robert M. Fetsuga

*Attorney, Agent, or Firm*—Palmatier, Sjoquist & Helget

[57] ABSTRACT

A hammock style campers' toilet seat for suspension between trees. The toilet seat includes a web of support straps for lending longitudinal and lateral strength to the seat, and a resilient stiffener ring running about the toilet opening for lending stiffness to the relatively flexible seat about the toilet opening.

10 Claims, 2 Drawing Sheets

HAMMOCK STYLE CAMPERS' TOILET SEAT

BACKGROUND OF THE INVENTION

The present invention relates to toilet seats and, more particularly, to hammock style toilet seats that are strung between two trees for use by campers.

The majority of state and national parks have conventional bathroom facilities. Even wilderness areas such as the Boundary Waters in northern Minnesota and Isle Royale National Park in Michigan have outhouses in relatively remote areas in an effort to preserve campsites utilized by literally thousands of people.

However, even taking into account the park facilities now available, no comfortable toilet means exists for the backpacker, canoeist, or cyclist who may travel to and set up camp in remote regions unmanaged by state or federal park authorities. To answer Mother Nature's call, such a camper may squat, lean against a tree, or tie two to three limbs in parallel fashion between two trees to form a toilet seat of a general L-shape in section.

SUMMARY OF THE INVENTION

A feature of the present invention is a hammock style toilet seat.

Another feature is the provision in a hammock style toilet apparatus, of a web of support straps to form a seat for the toilet apparatus.

Another feature is the provision in a hammock style toilet apparatus with a toilet seat formed of flexible material and having a toilet opening, of a stiffener ring having greater stiffness than the flexible material and running about the toilet opening to lend stiffness and support to the seat about the toilet opening.

Another feature is the provision in a hammock style toilet apparatus, of the stiffener ring being resilient such that the toilet seat may be rolled up to a compact form.

An advantage of the present invention is a toilet seat that may be set up most anywhere.

Another advantage of the present invention is that it is comfortable. One feature providing this comfort is the resilient stiffener ring. Another important feature relative to this advantage is the smooth vinyl upper layer which lacks stitching that might otherwise be irritating. The oblique seat edges over which one's legs lie also contribute to this comfort.

Another advantage of the present invention is that it is sanitary. The upper and lower layers of the seat are formed of a nonporous vinyl which is easily cleaned.

Another advantage of the present invention is that it is strong. One feature contributing to this advantage is the web of support straps. Other contributing features are the upper and lower layers of the vinyl material. It should be noted that even one layer of this vinyl material is sufficiently strong to be strung between two trees to form a hammock style toilet seat without a web of support straps.

Another advantage of the present invention is that it is aesthetic.

Another advantage of the present invention is that it is simple and inexpensive to manufacture.

Another advantage of the present invention is that it is simple to set up.

DETAILED DESCRIPTION OF THE PREFERRED EMBODIMENTS

Figure 1:
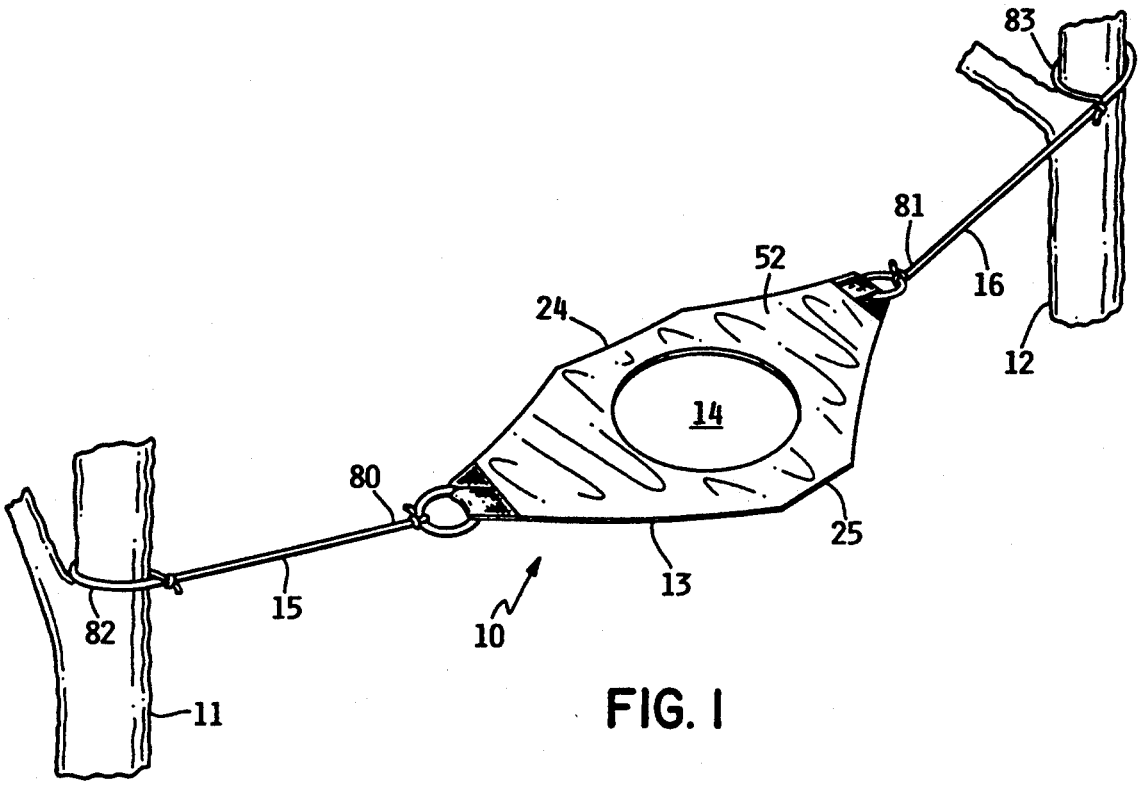
FIG. 1 is an environmental view of the present hammock style toilet seat suspended between two trees.

As shown in FIG. 1, the present hammock style toilet apparatus is indicated in general by the reference numeral 10 and is strung between two trees 11, 12. The apparatus 10 includes a seat 13 forming a toilet opening 14, and ropes 15, 16 for suspending the seat 13 between the trees 11, 12.

Figure 3:
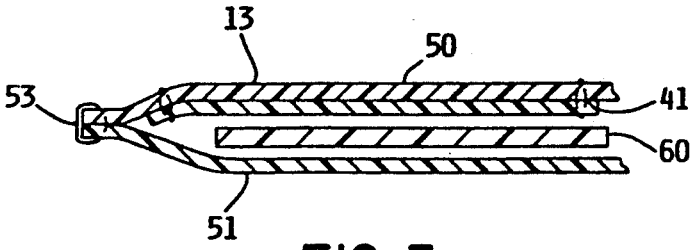
FIG. 3 is a section view at lines 3—3 of FIG. 2.
Figure 2:
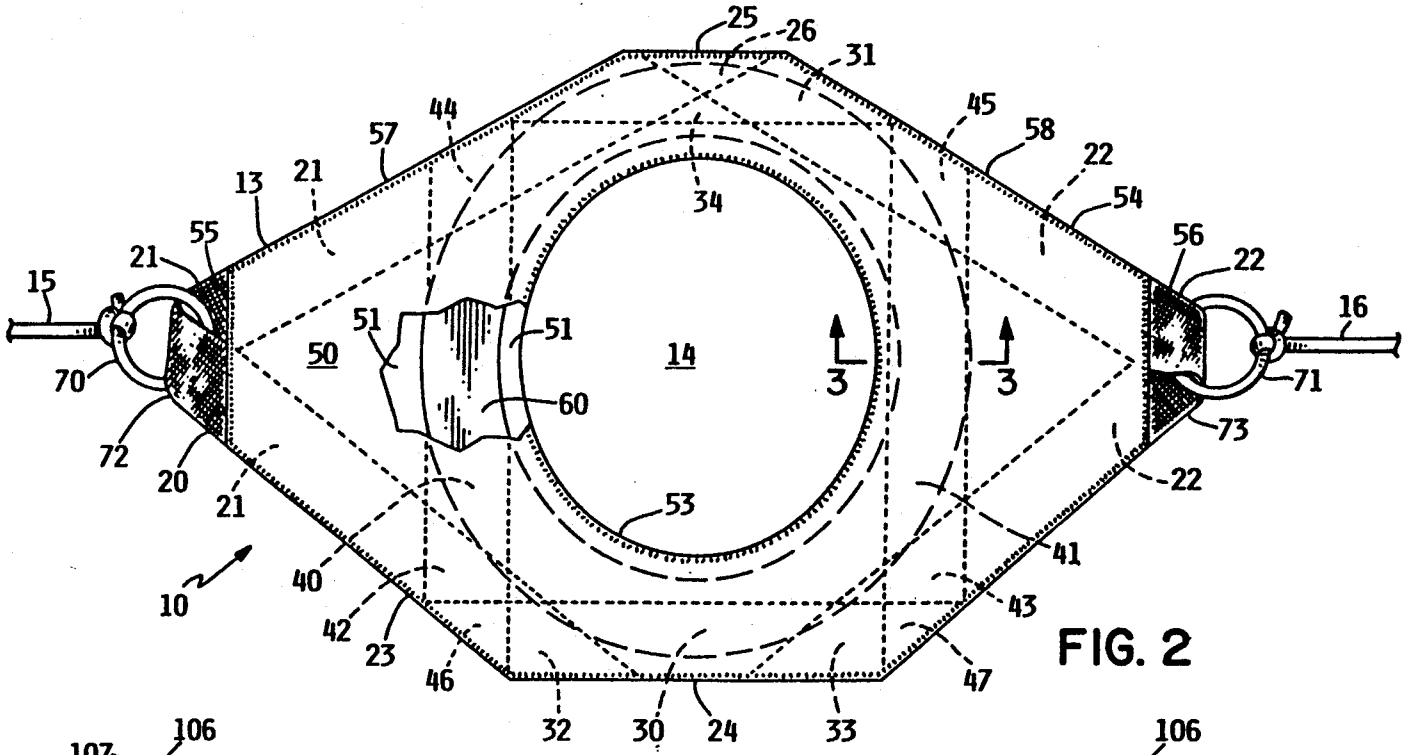
FIG. 2 is a bottom plan view of the hammock style toilet seat of FIG. 1.
Figure 5:
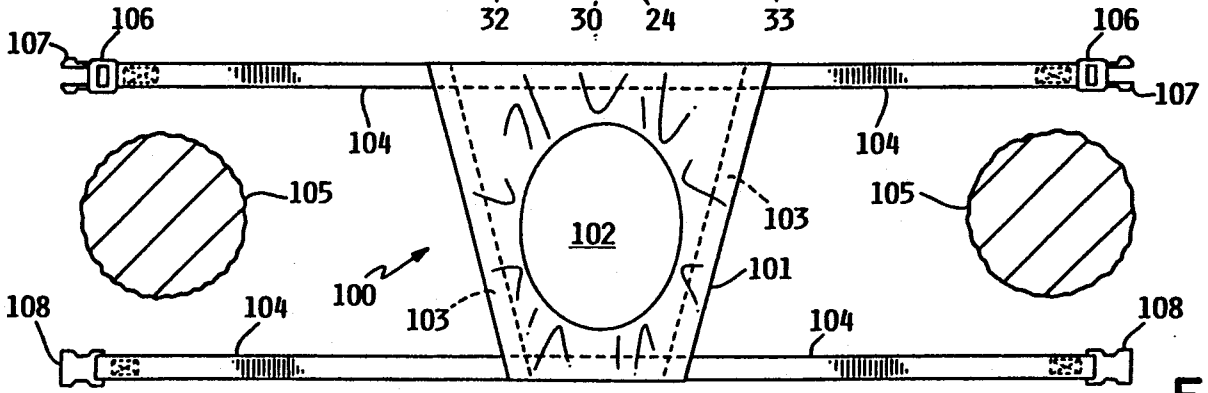
FIG. 5 is a top plan view of an alternate embodiment of the hammock style toilet seat.

With more specificity, as shown in FIGS. 1–3, the seat 13 includes a web 20 of support straps for lending strength to the seat 13. The support strap web 20 includes a pair of respective, suspension, oblique strap portions 21, 22, each of which generally forms the shape of a V. The suspension strap portions 21, 22 run substantially about a periphery 23 of the seat 13 from a rear region 24 of the seat 13 to a front region 25 of the seat 13. At the front region 25, the strap portions 21, 22 overlap and are stitched together to form a triangular, overlap portion 26.

A pair of longitudinal strap portions 30, 31 tie the V-shaped strap portions 21, 22 to each other. At the rear region 24, the longitudinal strap portion 30 overlaps and is stitched to the V-shaped strap portions 21, 22 to form trapezoidal overlap portions 32, 33. At the front region 25, all of the longitudinal strap portion 31 overlaps the V-shaped strap portions 21, 22 except at a triangular nonoverlap portion 34. The strap portions 30, 31 extend longitudinally and adjacent to the toilet seat opening 14 and on the periphery 23.

A pair of lateral strap portions 40, 41 tie the longitudinal strap portions 30, 31 together at opposite sections of each the V-shaped strap portions 21, 22. The lateral strap portions 40, 41 overlap and are stitched to respective opposite portions of the V-shaped strap portions 21, 22 to form a set of four respective trapezoidal overlap portions 42, 43, 44, 45. The lateral strap portions 40, 41 also overlap and are stitched to the longitudinal strap portion 30 to form respective overlap portions 46, 47.

It should be noted that some of these overlap portions include triple overlaps. Such triple overlap portions include portions 26, 46, and 47. It should further be noted that such overlapping and stitching is preferable to using one continuous length of strapping, which may include bending the strapping at the corners or folding the strapping into sections. Such a bending or folding of the strapping may be utilized if desired, but may produce uncomfortable lumps on the seat 13.

The web 20 may be utilized as a hammock style toilet seat in and of itself when strung between two locations such as the trees 11, 12. The longitudinal and lateral strap portions 30, 31, 40, 41, and small sections of the V-shaped strap portions 21, 22, form an eight-sided toilet opening and provide comfortable support for one's behind.

The strap portions of the web 20 are stitched to each, other and are also stitched to a lower flexible layer 51 formed of a vinyl material, which in turn is stitched to an upper flexible layer 50 formed of a vinyl material. The strap portions of the web 20 are stitched only to the lower layer 51 to provide a smooth, non-irritating, upper surface 52 to the upper layer 50.

The layers 50, 51 are stitched together at an interior continuous edge 53 to form the oval toilet opening 14. The layers 50, 51 are also stitched together at an outer peripheral edge 54, which includes end peripheral portions 55, 56. The stitching of the end peripheral portions 55, 56 engages the V-shaped strap portions 21, 22. It should be noted that obliquely extending edge portions 57, 58 of the peripheral edge 54 extend obliquely with respect to the ropes 15, 16 for an ergonomic comfortable support for one's legs. It should further be noted that the layers 50, 51, or even one of the layers 50, 51, provides sufficient strength for the seat 13 even without the support web 20.

Figure 4:
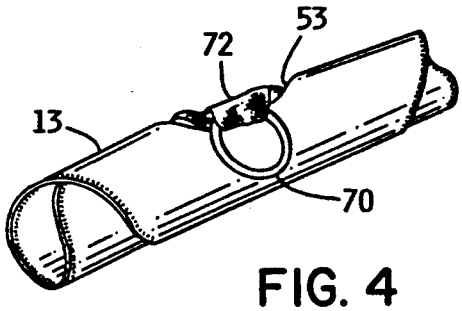
FIG. 4 is a perspective view of the hammock style toilet seat of FIG. 1 in a rolled-up, compact form.

A stiffener ring 60 is floatably or slidably engaged between the layers 50, 51 about the toilet opening 14 to provide stiffness thereabout. Specifically, the ring 60 is disposed between the web 20, which is affixed to the lower layer 51, and the upper layer 50. The ring 60 is formed of a material, such as polyethylene, which is of greater stiffness than the vinyl layers 50, 51, but which is resilient to permit the toilet seat 13 to be rolled up to a compact form as shown in FIG. 4. The ring 60 is preferably not stitched or attached to the layers 50, 51 or strap support web 20 to minimize kinking of or separation of the ring 60 from the layers 50, 51 or web 20. It should be noted that the ring 60 provides a relatively great surface area for comfortable support of one's rear end and distribution of the weight thereof. It should further be noted that the width of the ring 60 is approximately the width of each of the strap portions of the web 20.

A pair of metal annuli 70, 71 engage exposed strap sections 72, 73 of the V-strap portions 21, 22 of the web 20 which extend out of the seat layers 50, 51. The metal annuli 70, 71 also engage the ropes 15, 16 which extend upwardly from the seat 13 to the trees 11, 12. It should be noted that the strap sections 72, 73 engage their respective annuli 70, 71 in opposite fashion so that the seat 13 lies horizontal and is less prone to tipping or twisting. In other words, strap section 72 extends upwardly through annulus 70 from the rear region 25, while strap section 73 extends upwardly through annulus 71 from the front region 25.

The ropes 15, 16 are preferably tied to the annuli 70, 71, but it should be noted that the ropes 15, 16 may be inserted through and tied to the looped strap sections 72, 73. The ropes 15, 16 may be referred to as flexible elongate suspension means. The ropes 15, 16 include respective proximal ends 80, 81 and respective distal ends 82, 83.

With respect to materials, the strap portions of the web 20 are typically formed of polypropylene, the stiffener ring 60 is typically formed of polyethylene and is 0.060 inches thick, and as noted previously the layers 50, 51 are typically formed of vinyl. The annuli 70, 71 are of nickel plated welded steel to be rust resistant. The ropes 15, 16 are typically nylon. Such materials are easy to clean, sanitary, and resistant to deterioration.

It should be noted that the seat 13 may be plastic molded, if desired, and be substantially one piece.

In operation, the ropes 15, 16 are tied to the annuli 70, 71 and subsequently tied to the trees 11, 12 in a hammock style to suspend the seat 13 off of the ground. The seat 13 is tied slightly higher than a conventional toilet seat as the ropes 15, 16, the tied connection to the trees, and the seat 13 itself may give somewhat in response to the weight of the person on the seat 13.

An alternate embodiment 100 of the present invention, as shown in FIG. 6, includes a trapezoidal vinyl seat 101, an oval toilet seat opening 102, and lateral and longitudinal support straps 103, 104. The lateral straps 103 are stitched to the seat 101 and to the longitudinal support straps 104, which are also stitched to the seat 101. Each of the distal ends of each of the longitudinal straps 104 includes a portion of a quick release means for engaging the straps 104 to each other and to trees or locations 105. The quick release means includes a male connector portion 106 having a pair of resilient barbed prongs 107 for engaging a female connector 108. The connectors 107, 108 are readily disengaged by pressing the prongs 107 toward each other to release their barbs from the female connector 108. It should be noted that the longitudinal straps 104 may be referred to as flexible elongate connection means and that the quick release means may be fixed on either proximal or distal ends of the straps 104.

It should be noted that a binding, perhaps ¾" wide, may fold over and be sewn or glued along the stitching on the outer periphery 23 and around the inner periphery or edge 53 to provide a "finished" look to the toilet apparatus 10.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hammock style toilet apparatus for suspension between two locations, comprising:

(a) a seat having upper and lower layers, a toilet opening, two ends, and a stiffener ring slidably engaged to said seat between said upper and lower layers, said stiffener ring being aligned to said opening to provide support to said seat adjacent to said opening, said seat being formed of a flexible material, said stiffener ring being formed of a material having a greater stiffness than said flexible material of said seat; and (b) flexible elongate suspension means sized to extend between said ends and said two locations for suspending said seat between said two locations, said flexible elongate suspension means extending upwardly from said seat when said flexible elongate suspension means are connected to said two locations.

2. The toilet apparatus of claim 1, wherein the seat further comprises a plurality of support straps forming a web.

3. The toilet apparatus of claim 1, wherein the seat includes a periphery, and at least one support strap running about the periphery of said seat.

4. The toilet apparatus of claim 1, wherein the seat includes at least one support strap running adjacent to and about the toilet opening.

5. The toilet seat apparatus of claim 1, wherein the stiffener ring is resilient whereby the seat may be rolled up to a compact form.

6. The toilet apparatus according to claim 1, wherein each of the ends is formed by folding of said support straps, the support straps extending across the seat, the flexible elongate suspension means being engaged adjacent to the support straps.

7. The toilet apparatus of claim 6, further comprising an annulus engaged on each of the ends by the support strap portions, each of the annuli also being engaged by the flexible elongate suspension means.

8. The toilet apparatus of claim 1, wherein the seat includes a periphery front edge having a pair of obliquely extending portions extending obliquely relative to flexible elongate suspension means whereby one's legs comfortable engage the seat.

9. A hammock style toilet apparatus for suspension between two locations, comprising:

(a) a seat having a toilet opening and two ends and comprising:

(1) a web of support straps, the web having strap portions forming the two ends, the seat having a periphery about which the support straps run, the web having strap portions which run adjacent to the toilet opening and which are affixed between opposite portions of the periphery to provide transverse support to the seat;

(2) upper and lower layers of flexible material affixed between the ends and forming the toilet opening, the web of support straps fixed to at least one of the layers of the material to lend support thereto; and (3) a stiffener ring slidably engaged between the layers of material and running about the toilet seat opening to lend stiffness to the seat about the toilet seat opening, the stiffener ring being of greater stiffness than the material, the stiffener ring being resilient whereby the seat may be rolled up to a compact form;

(b) a pair of annuli engaged with the strap portions forming the ends; and (c) a pair of ropes extending from respective annuli to be engaged with the locations, the ropes extending upwardly from the seat when the ropes are engaged with the locations.

10. A hammock style toilet apparatus for suspension between two locations, comprising:

(a) a seat having upper and lower layers, a toilet opening, two ends, a plurality of support straps forming a web, said seat further having a periphery where at least one of said support straps surround said periphery and at least one of said support straps surround said opening, said seat further having a stiffener ring slidably engaged between said upper and lower layers, said stiffener ring being aligned to said opening to provide support to said seat adjacent to said opening, said stiffener ring being resilient whereby said seat may be rolled to a compact form, said seat being formed of a flexible material and said stiffener ring is formed of a material having a greater stiffness than said flexible material of said seat; and (b) flexible elongate suspension means sized to extend between said ends and said two locations for suspending said seat between said two locations, said flexible elongate suspension means extending upwardly from said seat when said flexible elongate suspension means are connected to said two locations.

* * * * *